US006398697B1

(12) United States Patent
Nichols, Jr.

(10) Patent No.: US 6,398,697 B1
(45) Date of Patent: Jun. 4, 2002

(54) GLANCE BLOW DETECTING PUNCH, KICK AND BLOCKING BAG AND STAND

(76) Inventor: Ernest Nichols, Jr., 5100 Equestrian Way, Antioch, CA (US) 94509

( * ) Notice: Subject to any disclaimer, the term of this patent is extended or adjusted under 35 U.S.C. 154(b) by 0 days.

(21) Appl. No.: 09/563,992

(22) Filed: May 3, 2000

Related U.S. Application Data

(60) Provisional application No. 60/135,192, filed on May 21, 1999.

(51) Int. Cl.[7] ..... A63B 69/34
(52) U.S. Cl. ..... 482/87; 482/90; 473/441
(58) Field of Search ..... 482/83–90; 473/441–445; 256/16; 119/524, 738; 472/93; 446/236, 396, 486

(56) References Cited

U.S. PATENT DOCUMENTS

| | | | | | |
|---|---|---|---|---|---|
| 318,766 | A | * | 5/1885 | Longden | 482/89 |
| 2,334,360 | A | * | 11/1943 | St. John | 482/86 |
| 2,677,545 | A | * | 5/1954 | Ross | 482/87 |
| 3,510,131 | A | * | 5/1970 | Gardner | 482/90 |
| 4,557,478 | A | * | 12/1985 | Levine | 482/89 |
| 4,903,966 | A | * | 2/1990 | Liao | 273/26 R |
| 4,911,428 | A | * | 3/1990 | Wiece | 482/87 |
| 4,940,228 | A | * | 7/1990 | Horvath et al. | 272/76 |
| 5,554,088 | A | * | 9/1996 | Zlojutro | 482/83 |
| 5,607,377 | A | * | 3/1997 | Wilkinson | 482/27 |
| 5,674,157 | A | * | 10/1997 | Wilkinson | 482/27 |
| 5,863,278 | A | * | 1/1999 | Chen | 482/83 |
| 5,921,895 | A | * | 7/1999 | Lynch et al. | 482/83 |
| 5,941,801 | A | * | 8/1999 | D'Alto | 482/83 |

* cited by examiner

*Primary Examiner*—Jerome W. Donnelly
*Assistant Examiner*—Victor Hwang
(74) *Attorney, Agent, or Firm*—Charles L. Thoeming

(57) ABSTRACT

The present invention presents a glance blow detecting bag which rotates on a pivotal axis around a circular in shape adjustable bag mounting pole which is supported on a portable free standing stand for exercising and training a punch boxer, kick boxer, or football blocker, to strike the center of a moving target, and the center of a specific body part. The glance blow detecting bag assists in training accurate placement of blows by spinning rapidly upon detecting a glance blow when the center of the bag is missed on impact, and not spinning when the center of bag is hit indicating a good strike.

8 Claims, 10 Drawing Sheets

GLANCE BLOW DETECTING PUNCH, KICK AND BLOCKING BAG AND STAND

This application claims the benefit of the filing date of applicant's provisional patent application No. 60/135,192 filed May 21, 1999.

BACKGROUND OF THE INVENTION

There are many punching bags, martial art kick bags and football blocking bags used as training and fitness devices on the open market for exercising and training today, but none of these exercising and training devices will develop a boxer or football player's ability to hit the center of a moving target and detect when the center is missed by spinning. It is a well known fact that a punch, kick, or block to the center of an object or specific part of the body is the most effective blow on impact. There is no training bag on the open market which indicates glance blows on impact when hit with a blow or block. When using the traditional punching, kicking and blocking bags the challenger or exerciser must stand directly in front of the punching, kicking and blocking device, striking or blocking the bag repeatedly with very little body movement. There's a need for a free standing exercising and training device supported on a flexible bag mounting pole and portable free standing stand, that has rotatable means, that meets the all round training and exercise needs of one or more punch boxer, kick boxer or foot ball blocker; for example a punching, kicking and blocking device that would indicate a glance punch, kick or block on impact by spinning rapidly.

There is a need for a pivotal punching bag device with rotatable means for detecting a glance blow, supported on a flexible bag mounting pole on a free standing stand that moves aggressively back at the challengers when hit with a blow or block, causing a boxer to use body and foot movement to avoid being hit by the bag; for example ducking to the left and right or leaning back to avoid being hit by the bag.

There is a need for a training device supported on a free standing flexible mounting pole and stand which allows one or two exercisers or trainees to move body, feet, and legs, 180 degrees to the left or 180 degrees to the right while striking the bag. The exerciser or trainee must avoid throwing glancing blows by hitting the moving bag in the center. The challenger or challengers must also avoid being hit by the aggressively moving punching bag by blocking with their arms, and by using their legs, feet, and body movement.

SUMMARY OF INVENTION

A punching, kicking, and blocking device having rotatable means is presented according to the present invention for exercising, and training a punch boxer, kick boxer, or football blocker, to strike the center of a moving target or center of a specific body part, by spinning rapidly to detect a glance blow when the center of the bag is missed on impact of a blow.

It is an object of the present invention to provide a glance blow detecting punching, kicking and blocking device for training, exercising and recreational fun. The device of the present invention is supported on a flexible mounting pole and portable free standing stand and has a rotatable means of detecting a glance blow or block. The glance blow or block detecting bag is used to detect a glance blows, for example, glance punches, glance kicks and glance blocks, by rotating rapidly up to a possible 180 degrees on an axis around a mounting pole when a glance blow or block is thrown to the right side of the bag. Similarly, the detecting bag would rotate rapidly up to a possible 180 degrees when a glance blow or block is thrown to the left side of the bag. Additionally, the detecting bag would move aggressively back toward the challenger, or exerciser or trainee when hit with a blow or block, and not rotating when a blow or block is thrown to the center of the bag.

It is an object of the present invention to provide a flexible, pivotal training, exercising,-and recreational device supported on a free standing flexible mounting pole and stand which allows one or two exercisers or trainees to move body, feet, and legs. The recreational device of the present invention is rotatable 180 degrees to either the left or to the right of a vertical axis. While striking the bag, the exerciser or trainee must avoid throwing glance blows by hitting the moving bag in the center. The challenger or challengers must also avoiding being hit by the aggressive moving punching bag, and blocking with their arms, and using their legs, feet, and body movement while setting up the next punch, kick or block.

It is still a further object of the present invention to provide a glance punching, kicking and blocking bag and training, exercising, and recreational device, with rotatable means for detecting a glance blow for one, two, or more players. The device of the present invention is supported by a bag mounting pole and a flexible, free standing stand that trains challengers to effectively hit the center of a moving target. For example the center of the recreational device can be made to symbolize a body part such as the chest, stomach, front of head, side of head. If the challenger fails to directly strike the body part, the bag spins on impact. Good, solid centered blows to the body part are indicated when the bag does not rotate on impact. Additionally, points can be counted against the challenger when the bag hits the competing challenger's body.

It is a further objective of the present invention to provide a portable and economical boxing, martial art, and football blocker training device which can be assembled quickly inside or outside a building.

It is still a further object of the present invention to provide an exercising, training, or blocking device to assist young or older players in learning punching, boxing, and blocking skills.

A BRIEF DESCRIPTION OF THE DRAWINGS

Figure 19:
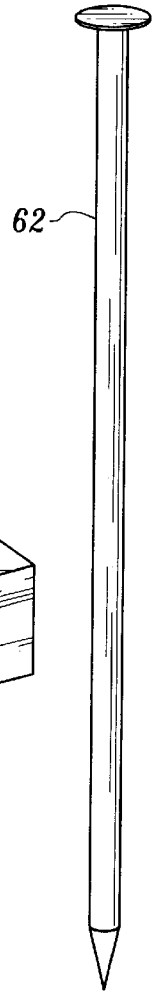

FIG. 19. is a perspective overall view of a common upholstery pin used as a vinyl tack pin.

Figure 20:
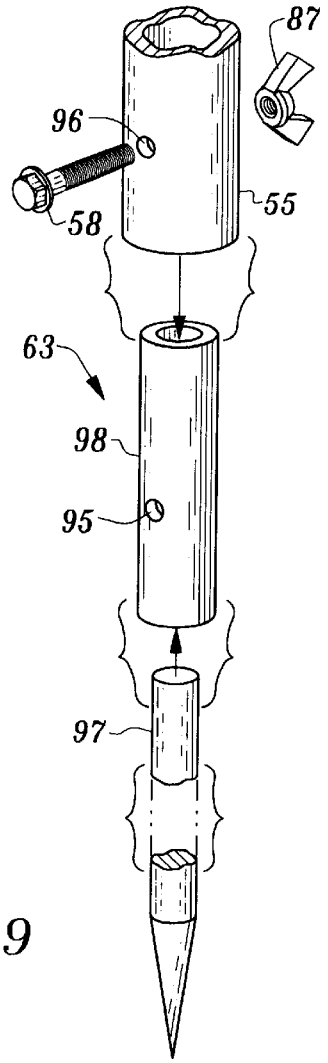

FIG. 20 is a constructional view of an embodiment of the bag mounting pole, showing the bag mounting pole with a mounting hole and a fastener at the end of the pole to allow the bag mounting pole to be mounted and held in place over the plastic to steel spike transition fitting.

Figure 21:
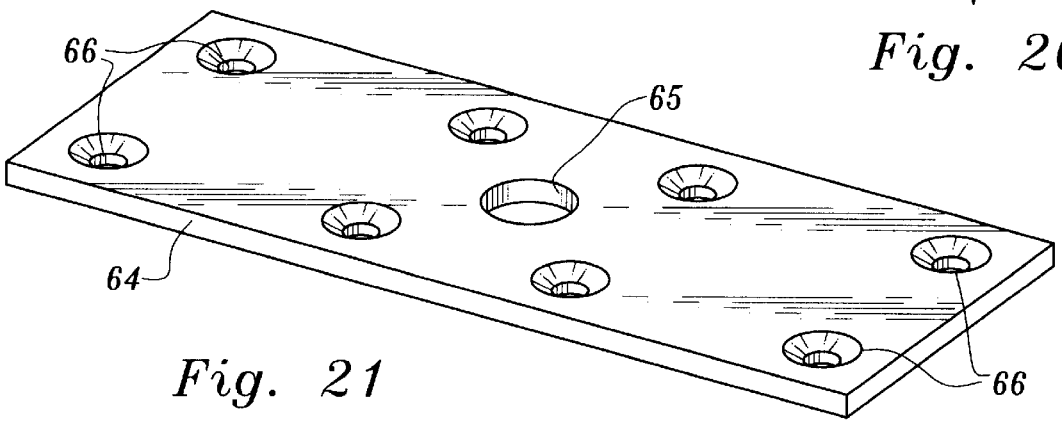

FIG. 21 is a perspective overall view of a pole vertical holding plate comprising a center mounting hole and fastener holes.

Figure 22:
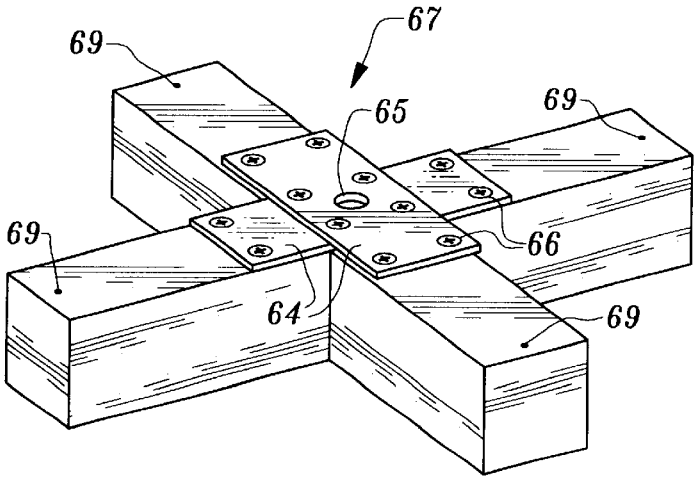

FIG. 22 is a perspective overall top view of a glance blow detecting bag mounting pole stand and vertical holding plate.

Figure 23:
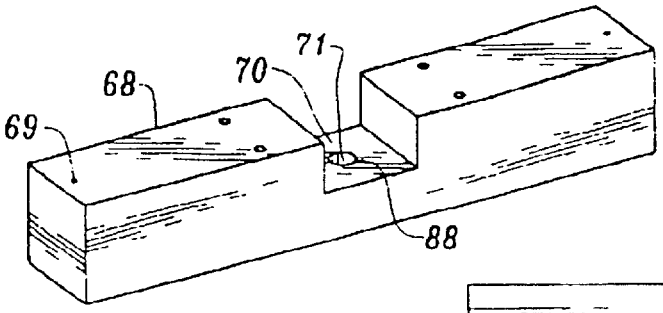

FIG. 23 is an overall side and top constructional view of a glance blow detecting bag's mounting pole stand cross member showing a valley, pole mounting hole, un-beveled side, and cross member spike holes, other than the heat flared bell on the opposite side of the cross member, the members being mirror images of each other.

Figure 24:
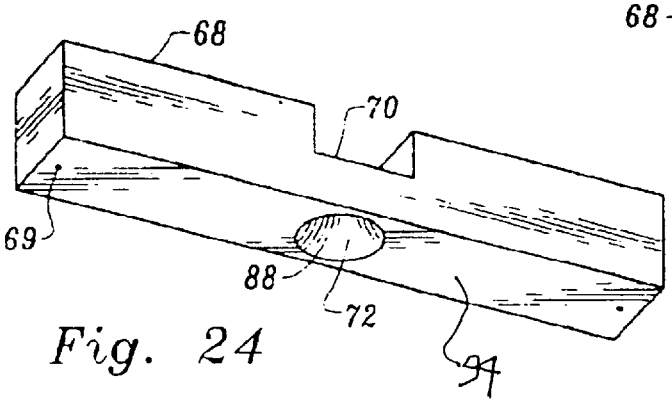

FIG. 24 is an overall bottom and side constructional view of a glance blow detecting bag's mounting pole stand cross member, showing the valley, spike holes, and the heat flared bell bottom side of the cross member pole mounting hole, other than the bevel the opposed side view is a mirror image of the view presented.

Figure 25:
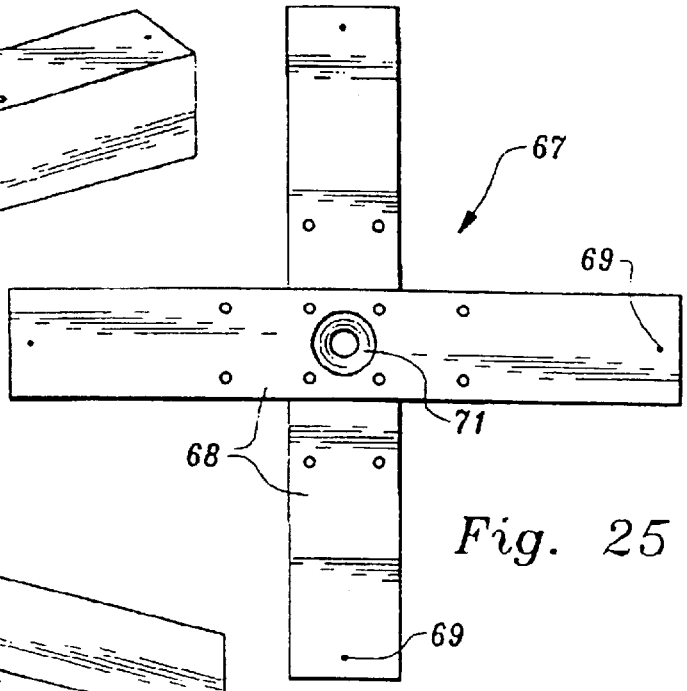

FIG. 25 is an overall top view of the glance blow detecting bag's pole mounting stand cross members interlocked to gather, the back side is a mirror of the top side.

Figure 26:
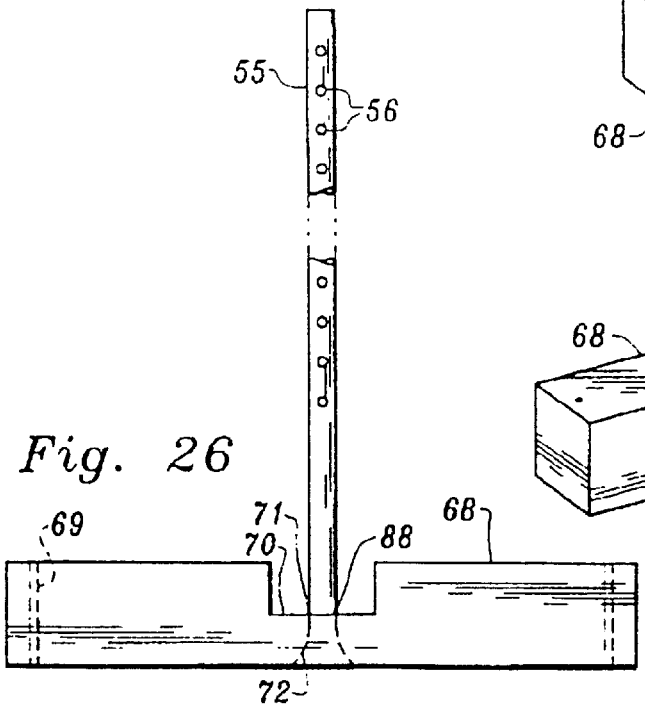

FIG. 26 is a side elevation view showing the assembly of the glance blow detecting punch, kick, and blocking bag, and recreational device showing the bag mounting pole installed through the bottom of the pole mounting stand cross member.

Figure 27:
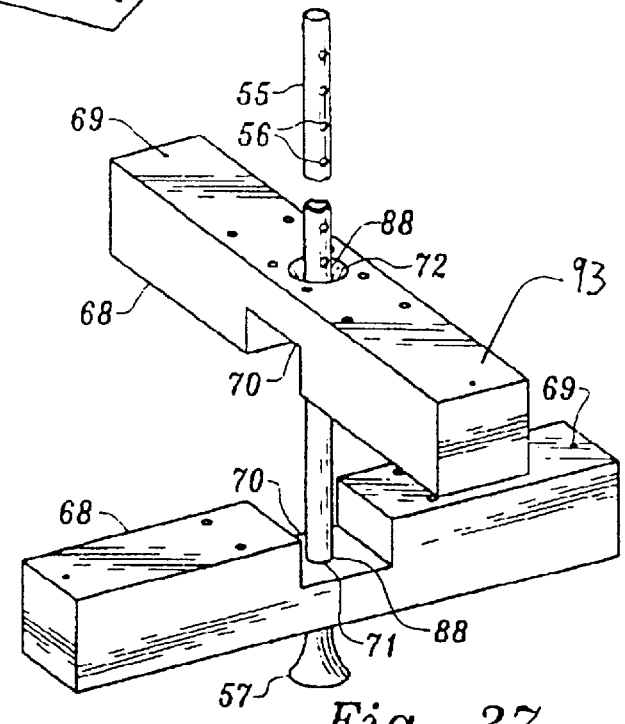

FIG. 27 is an elevational view of the second step of assembling the glance blow detecting punching, kicking, and blocking bag training, exercise, and recreational device showing the second cross member being installed to hold the mounting pole.

Figure 28:
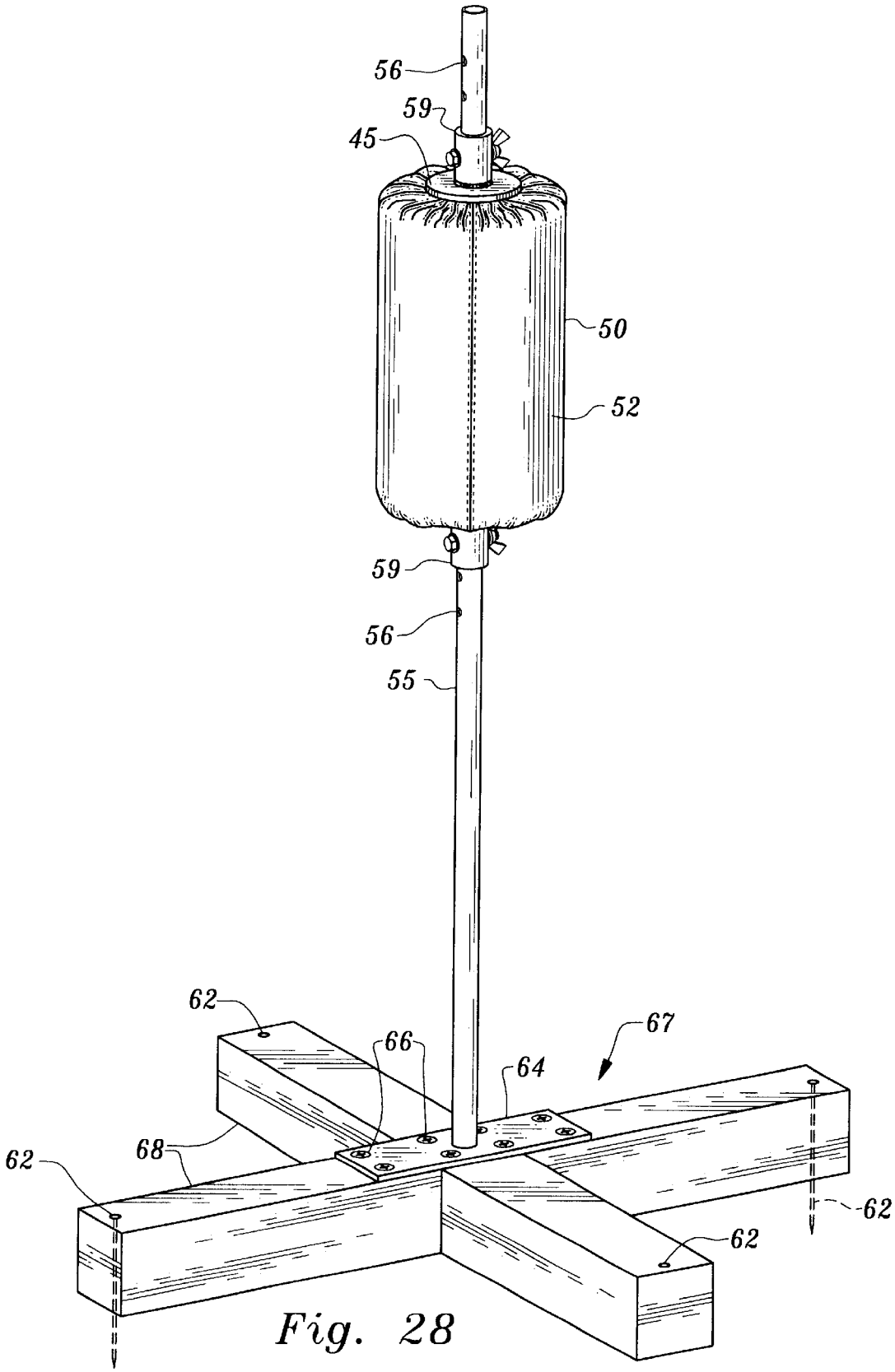

FIG. 28 is an elevational view of the glance blow detecting bag showing the installation of the pole stabilizer plate, the installation of the bottom adjustable height sleeve,-the installation of the glance blow detecting bag, the installation of the top adjustable height sleeve, and the installation of the spikes through the pole mounting stand to hold mounting stand in place.

Figure 29:
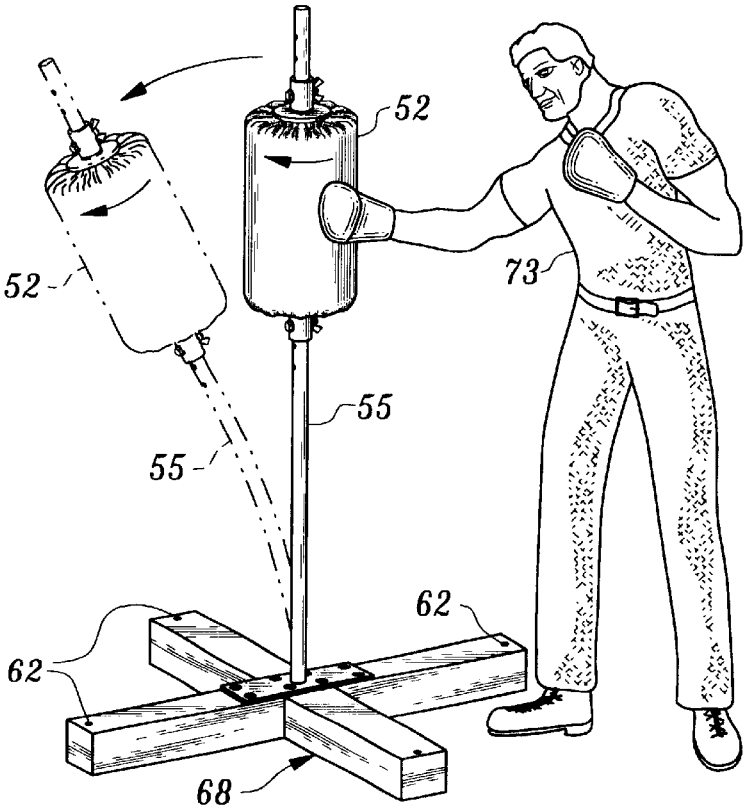

FIG. 29 is an elevational view of glance blow detecting bag and stand,_showing the stand held down with spikes and two bag pole vertical holders holding the bag mounting pole straight and further showing the bag spinning rapidly to the right after detecting the boxer's glance right punch, and the position of the bag after the punch.

Figure 30:
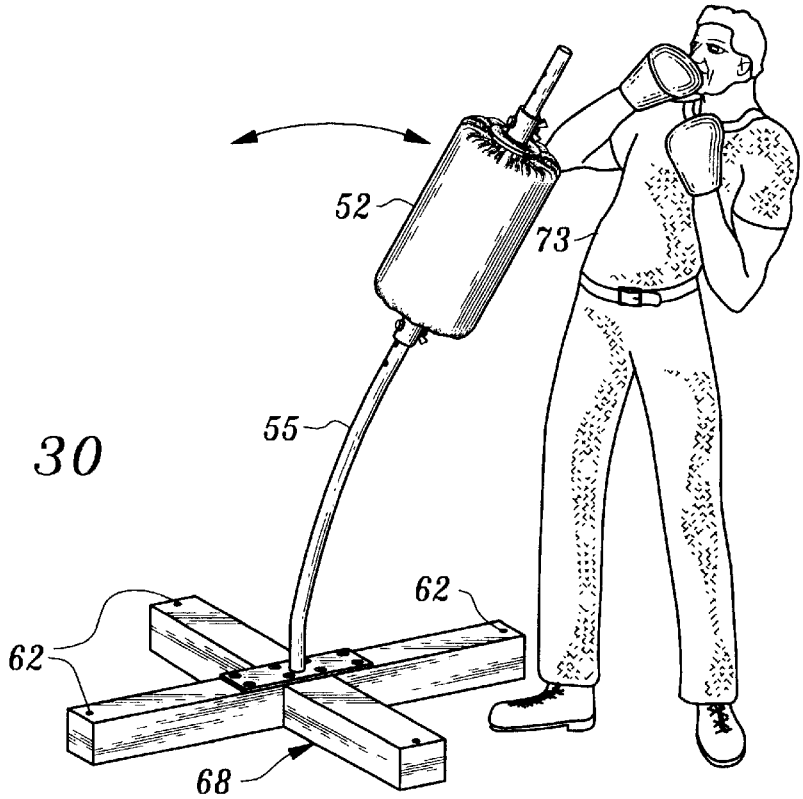

FIG. 30 is an elevational view of the glance blow detecting bag flexing back toward the boxer making the boxer duck to avoid being hit by the bag, where the boxer stands in a defensive posture as the bag rapidly passes by the boxer's shoulder.

Figure 31:
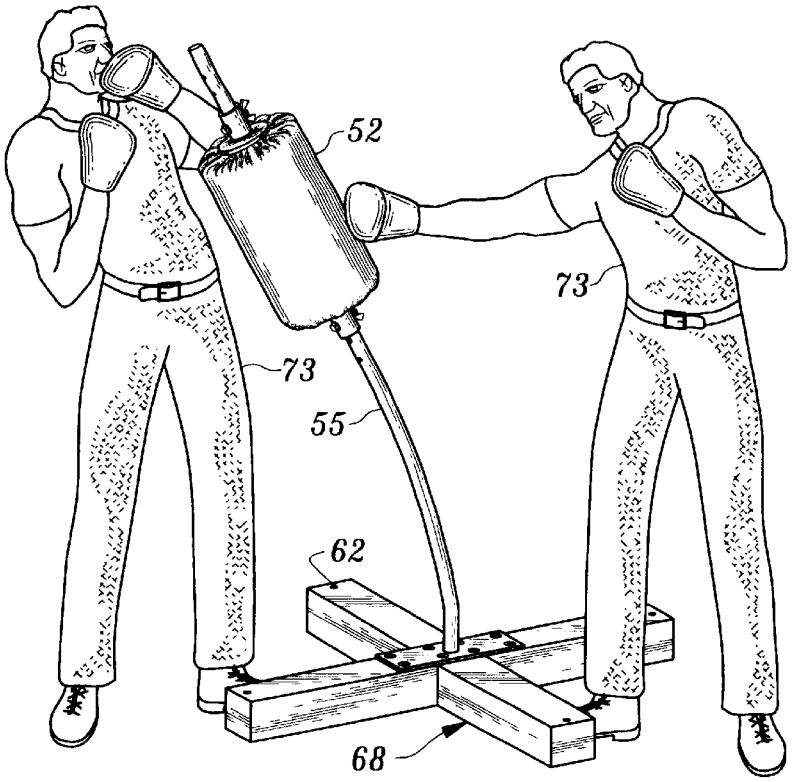

FIG. 31 is an elevational view of two challenging boxers who are judged on how many effective punches are thrown, not counting glance blows that spin the bag, one boxer is on the offensive and one boxer on the defensive.

Figure 32:
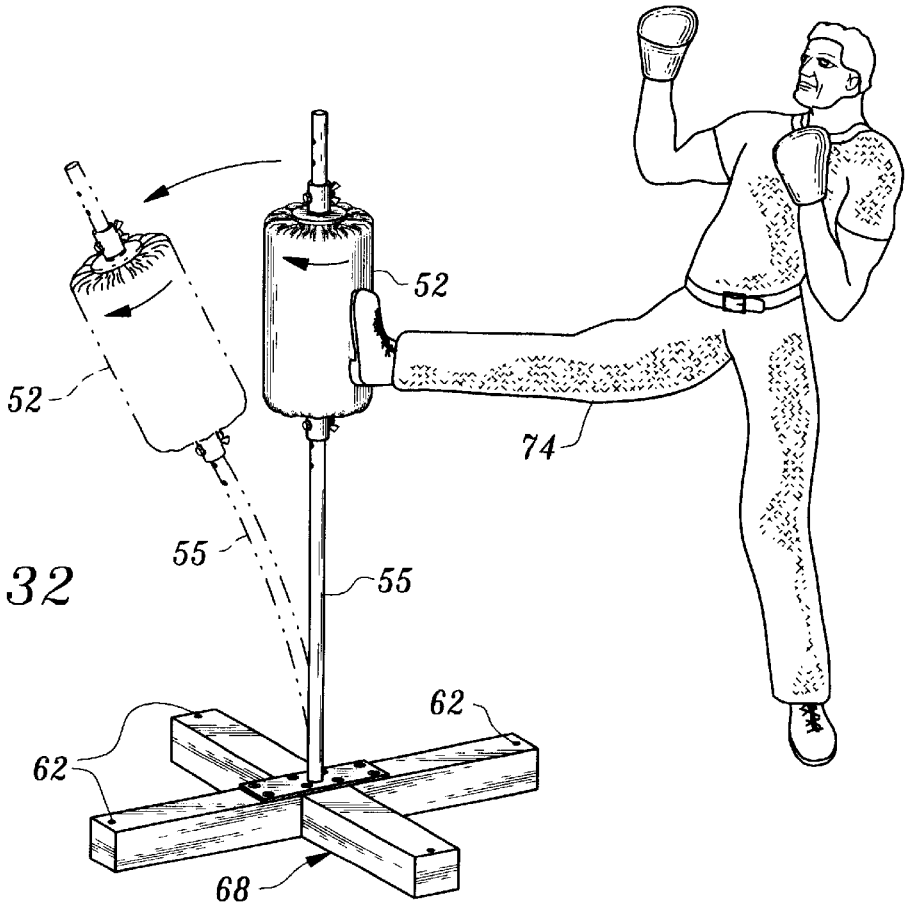

FIG. 32 is an elevational view of the glance blow detecting bag spinning rapidly to the right detecting the kick boxer's glancing right kick, showing the position of the bag after the kick, and where the stand is held in place with barbell weights slipped over the bag mounting pole.

Figure 33:
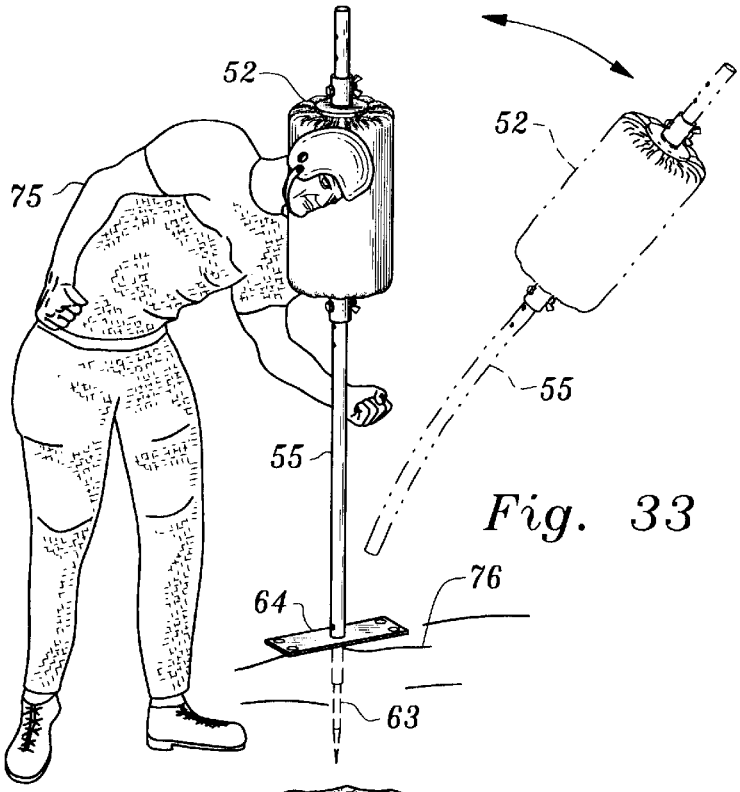

FIG. 33 is an elevational view of the glance blow detecting bag showing the bag mounting pole position after being hit with a block or tackle and showing further the plastic to steel transition fitting fastener is left out to allow the pole to fight off when hit with a block or tackle, and wherein the transition fitting is driven under ground, and further indicating how the bag fights off rapidly when the football players blocks or tackles the bag.

Figure 34:
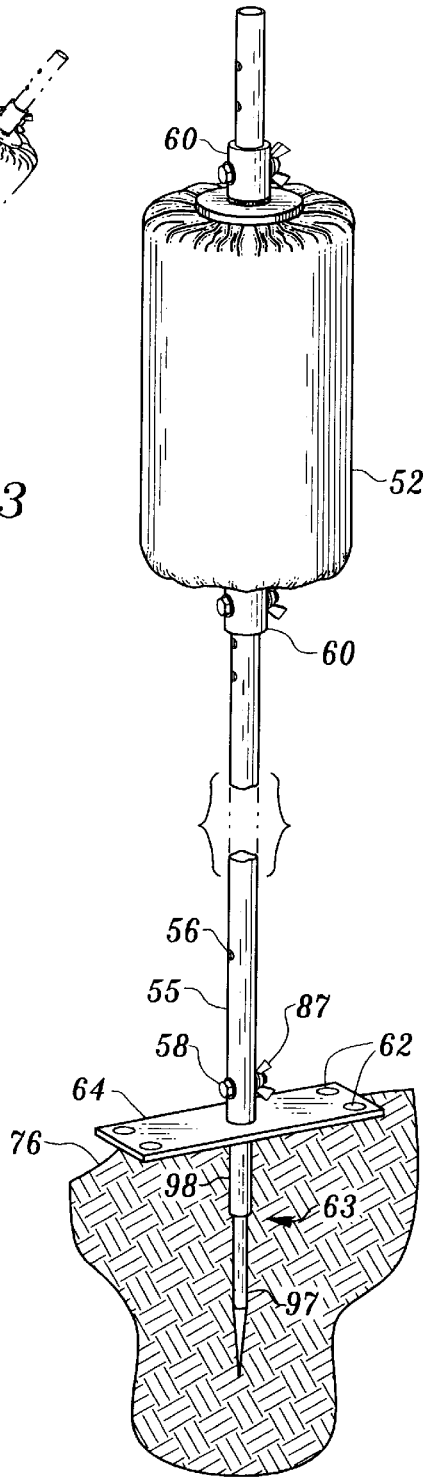

FIG. 34 is an elevational view showing the under ground mounting of the glance blow detecting bag and the bag mounting pole mounted on a plastic to steel spike transition fitting, with the spike pushed directly into the ground, and wherein the bag is being further supported with a pole vertical holder plate.

Figure 35:
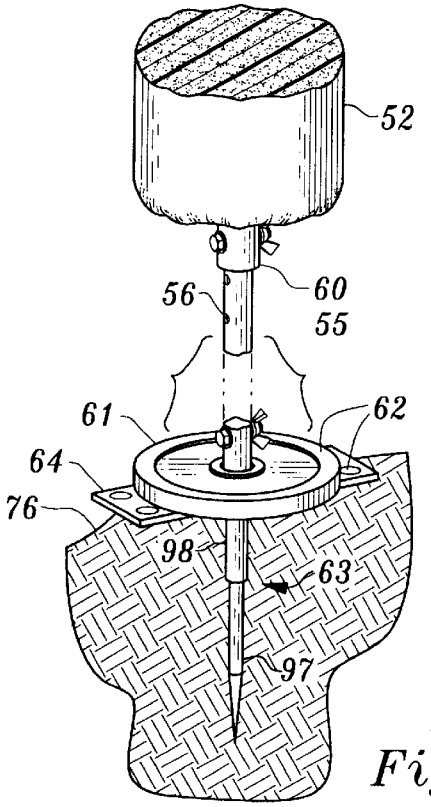

FIG. 35 is an underground view of the glance blow detecting bag, with the bag mounting pole mounted on a plastic to steel spike transition fitting with the spike pushed directly into the ground and being further supported with a pole vertical holder plate and barbell weights.

Figure 36:
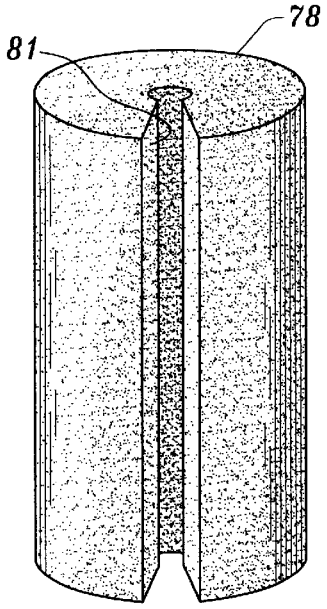

FIG. 36 is a constructional view of a foam cylinder split to the middle to accept the bag mounting tube, a optional method of mounting the foam cylinder to the bag mounting pole.

Figure 37:
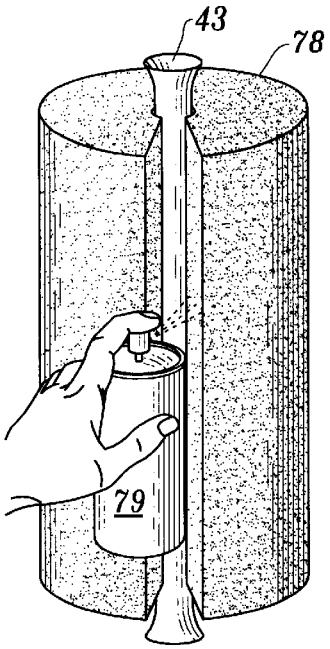

FIG. 37 is a constructional view of the bag mounting pole being installed to the middle of the spilt foam cylinder using foam adhesive spray to seal up the spilt foam.

Figure 38:
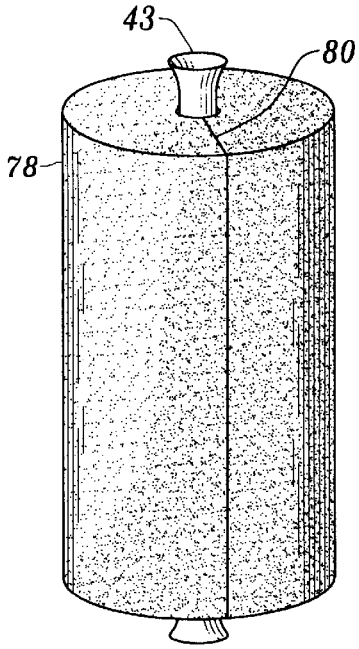

FIG. 38 is a constructional view of the split foam cylinder after being adhesively sealed back to gather, showing the sealed seam.

Figure 39:
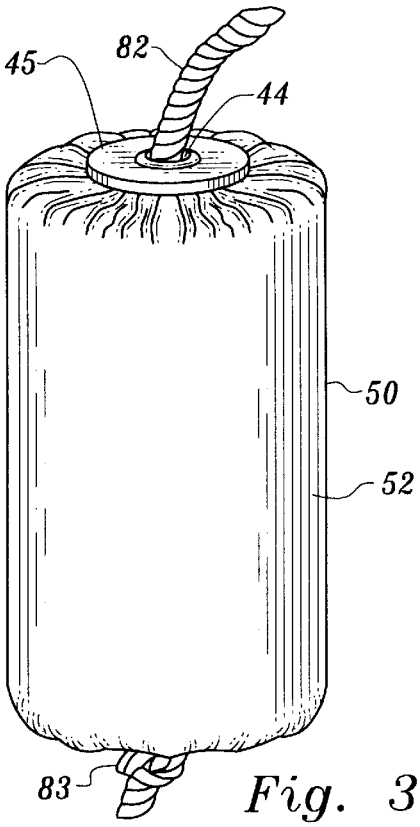

FIG. 39 is a view of the glance blow detecting punch, kick, and blocking bag showing a rope training throw the center of bag mounting tube, having a knot at the opposite end of the rope to trap the bag.

Figure 40:
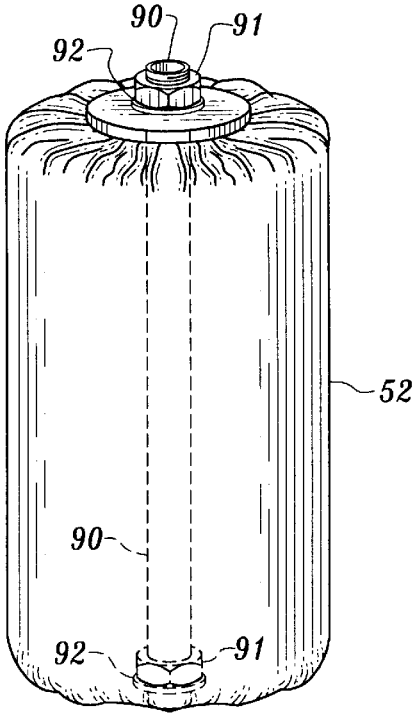

FIG. 40 is a constructional view of another embodiment of the glance blow detecting bag, showing a threaded bag mounting nipple comprising a mounting nipple washer and retainer nut.

DRAWING REFERENCES

41. foam cylinder
42. foam cylinder mounting hole
43 bag mounting tube
44. foam mounting tube with fared ends
45. hard ware cover plate
46. cover plate mounting hole
47. vinyl tack plate
48. tack plate mounting hole
49. vinyl tack plate pins
50. vinyl covering
51. covering seam
52. finished glance blow detecting punch, kick, and blocking bag
53. barbell mounting hole
54. foam mounting tube open end
55. adjustable flexible bag mounting pole
56. height adjustment holes
57. mounting pole bottom flared end
58. fastener
59. height adjustment sleeve
60. height adjustment sleeve hole
61. barbell weight
62. pole stand spike holder
63. plastic to steel spike transition fitting
64. pole vertical holder plate
65. vertical holder plate mounting hole
66. vertical holder plate fastener holes
67. pole mounting stand
68. stand cross member
69. stand spike hole
70. cross member valley
71. pole mounting hole un-beveled side
72. pole mounting hole bell out side
73. boxer
74. martial art kick boxer
75. football blocker
76. ground
78. foam cylinder split to the middle
79. foam adhesive spray
80. sealed seam
81. split
82. rope
83. rope knot
85. shank
86. flat head
87. wing nut
88. stand pole mounting hole
90. threaded bag mounting nipple
91. bag mounting nipple retainer nut
92. bag mounting nipple washer
93. cross member top side
94. cross member bottom side
95. transition mounting hole
96. bag pole mounting hole
97 transition steel spike
98. Polyvinyl Chloride ("PVC") transition tube

DESCRIPTION OF THE MAIN EMBODIMENT

Figure 6:
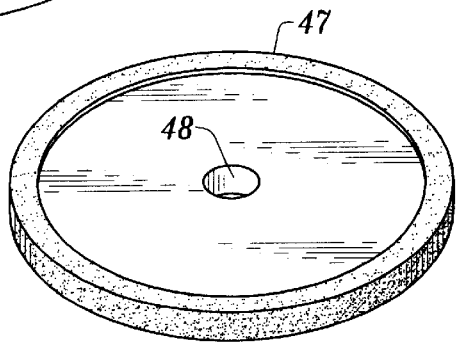
FIG. 6 shows an enlarged front view of the glance blow detecting bag's vinyl tack plate with mounting hole at center, with the back side presenting a mirror image of the front side.
Figure 7:
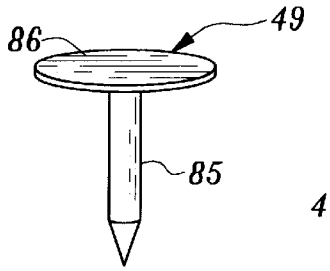
FIG. 7 shows an enlarged plain view of the glance blow detecting bag's vinyl tack pin.
Figure 14:
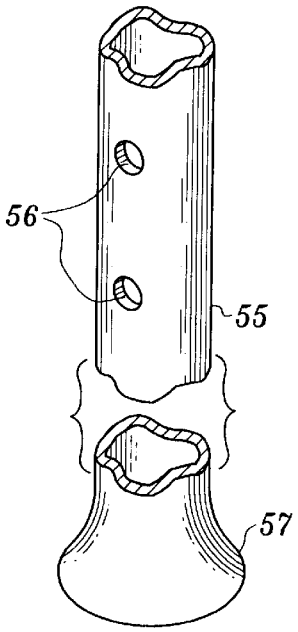
FIG. 14 is an enlarged constructional view of a glance blow detecting flexible bag mounting pole comprising adjustment holes and a flared end.
Figure 15:
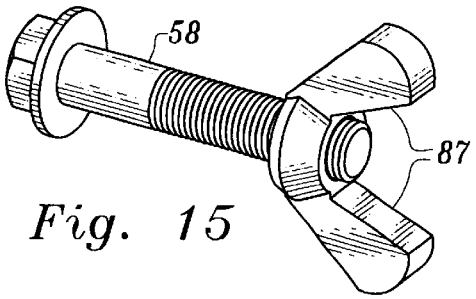
FIG. 15 is an overall constructional view of a wing nut screw fastener.
Figure 16:
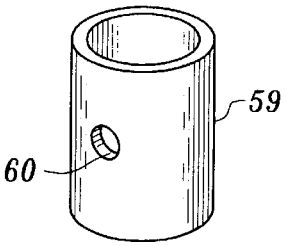
FIG. 16 is an overall view of a height adjustment sleeve.

The present invention provides a method of making, mounting and supporting a glance blow detecting punching kicking, and blocking bag 52 and free standing stand comprising a pivotal bag mounting tube 43, which is an open end 54 tube 43 of a predetermined length and predetermined diameter. The method further comprises a plastic foam cylinder 41 with mounting means, having a predetermined diameter and predetermined length, and having a foam cylinder mounting hole 42 at the center to allow insertable mounting onto the bag mounting tube 43. The method further comprises vinyl covering 50 means for covering the mounted foam cylinder consisting of a vinyl covering 50 seamed together into the shape of the foam cylinder 41 with open ends. The method further comprises retaining hardware for retaining the covering 50 on the foam cylinder consisting of a vinyl tack plate 47 and vinyl tack plate pins 49, and a cover plate. The vinyl tack plate rests on top of the foam cylinder around the bag mounting tube, consisting of a material firm enough and thick enough to hold a vinyl tack pin in place; for example, cardboard, synthetic materials, or plastics as seen in FIG. 6. The vinyl tack pins 49 as seen in FIG. 7 which are common upholstery pins having a large round flat head 86 and an approximate ½" shank 85, which is used to hold the covering 50 and tack plate 47 in place around the foam mounting tube 43. Other fasteners can be used to hold the vinyl covering 50 in place. The method further comprises heat softening the bag mounting tube 43 open ends 54 by using heat flaring 44 means to mount and retain objects such as, but not limited to, foam cylinders 41, vinyl covering 50, vinyl tack plates 47, and vinyl tack pins 49 onto the bag mounting tube 43. The method of making the glance blow detecting bag 52 and stand 67 further comprises a bag mounting pole 55 support means, which holds the glance blow detecting bag 52 in place on pivotal axis when the glance blow detecting bag 52 is mounted onto the bag mounting pole 55, to provide a rotational means for the glance blow detecting bag 52 to spin on glance blow to the bag, and to detect glance blows as seen in FIG. 29, FIG. 30, FIG. 31, FIG. 32, and FIG. 33. The method further comprises a bag mounting pole 55 for mounting and holding the rotatable glance blow detecting bag 52 in place on a pivotal axis around the bag mounting pole 55. The bag mounting tubing 43 inside diameter is greater then the PVC. bag mounting pole 55 outer diameter which comprises Polyvinyl Chloride ("PVC") pipe having height adjustment holes 56 up and down the bag mounting pole 55, wherein the adjustment holes travel completely through the mounting pole 55 in line to accept a fastener 58 and a wing nut 87 at the other outer side of the pole 55. The adjustment holes 56 are used to adjust the height of the glance blow detecting bag 52 and hold bag 52 in place as seen in FIG. 14. The bag mounting pole 55 can be made out of other materials, for example metal, fiberglass, or synthetic materials. The bag mounting pole 55 further comprises two approximately 2" in length and approximately ¼" thick, circular, tube like PVC height adjustment sleeves 59 for setting the height of the glance blow detecting bag 52 to allow the glance blow detecting bag 52 to rest pivotally and freely on the bottom adjustment sleeve 59 and rotate on a axis around the bag mounting pole 55 holding the bag 52 in place at the top to keep bag 52 from flying off the top when hit with a blow.

Figure 8:
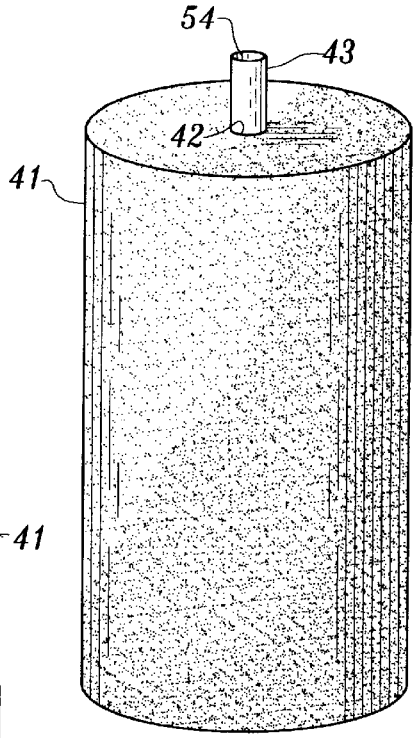
FIG. 8 shows an enlarged constructional view of the glance blow detecting bag's foam cylinder mounted on the mounting tube ready for covering.
Figure 9:
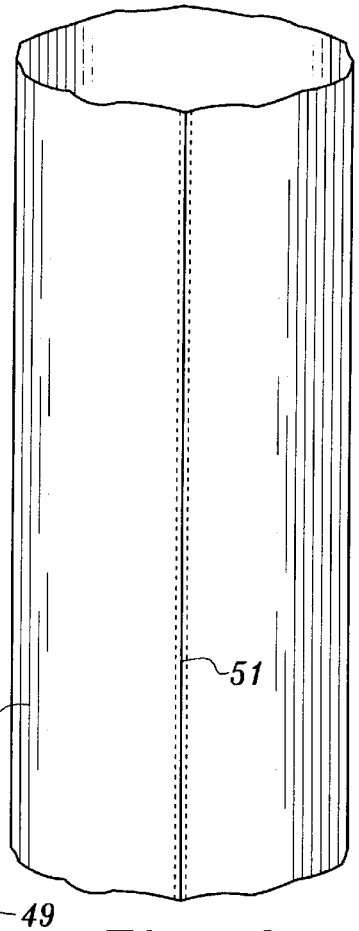
FIG. 9 shows an enlarged plain view of the glance blow detecting bag's vinyl covering with seam showing.
Figure 17:
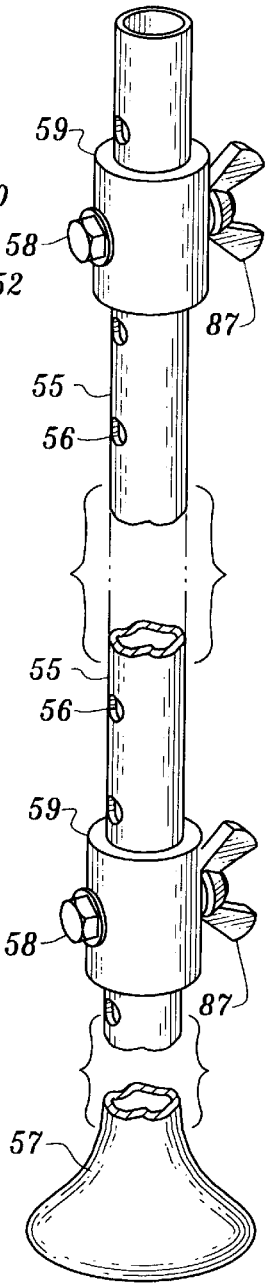
FIG. 17 is a perspective overall view of the flexible glance blow detecting mounting pole with height adjustment sleeves in place.
Figure 18:
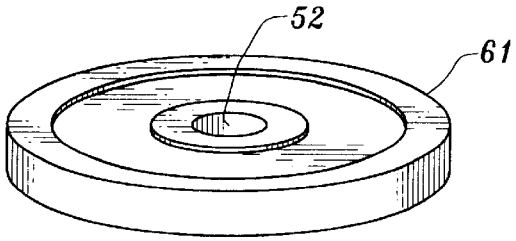
FIG. 18 is a perspective overall view of a barbell weight.

The height adjustment sleeve 59 has adjustment fastener holes 60 which travel completely through the complete diameter of the height adjustment sleeve 59 in line to allow a fastener 58 to travel completely through the adjustment sleeve 59 and the bag mounting pole adjustment hole 56, locking the bag 52 in place with a wing nut 87 at the other outer side of bag mounting pole 55 and adjustment sleeve 59 as seen in FIG. 17. The outer diameter of the bag mounting pole 55 is smaller in diameter than the diameter of the bag mounting tube opening 54 of the bag mounting tube 43 to allow the bag mounting tube 43 to slip over the bag mounting pole 55 and spin on a axis around the flexible bag mounting pole 55. The bag mounting pole 55 has a heat flared 44 bottom end 57 which traps the bag mounting pole in place. The bag mounting tube 43 is cut approximately the same length as the desired foam cylinder 41. The bag mounting tube 43 is inserted through the center of the foam cylinder mounting hole 42, as seen in FIG. 8

Figure 11:
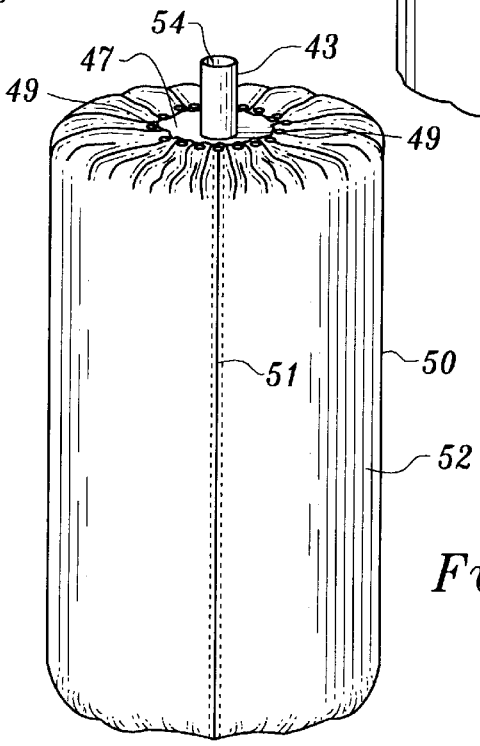
FIG. 11 is a constructional front and top view of the glance blow detecting bag showing the covering tuck in place in between the mounting tube and foam cylinder, with the bottom side presenting a mirror image of the top.

The glance blow detecting bag 52 and stand 67 further comprise a heavy vinyl cover 50 which is seamed 51 into the shape of the foam cylinder 41 with open ends 54 to fit the diameter and length of the desired foam cylinder 41. Other fabrics can be used to cover the foam cylinder 41 if desired. The vinyl covering 50 is pulled up over the foam cylinder 41, pleated in place, and tucked over the tack plate 47 down in between the foam cylinder mounting hole 42 and mounting tube 43 in a tight and neat fashion, as seen in FIG. 11. Tack pins 49 are installed through the vinyl covering 50 and tack plate 47 to hold the vinyl cover 50 in place at the tack plate 47. The top side and the bottom side of the bag 52 are finished to present mirror images of one another.

Figure 5:
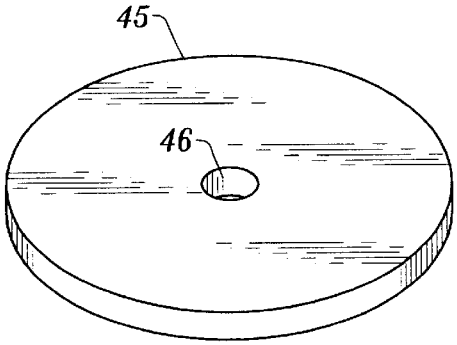
FIG. 5 shows an enlarged front view of the glance blow detecting bag cover plate with mounting hole at the center, with the back side presenting a mirror image of the front side above.
Figure 4:
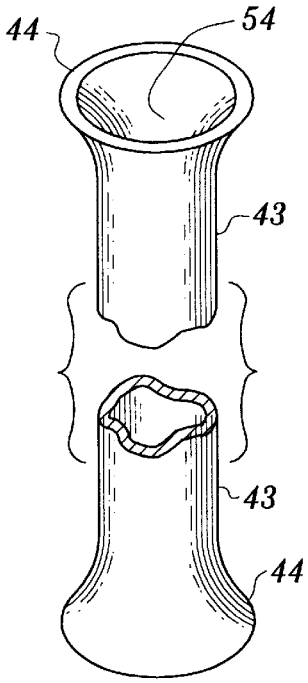
FIG. 4 shows an enlarged plain view of the glance blow detecting bag mounting tube with open ends flared out.

The glance blow detecting bag 52 further comprises a PVC cover plate 45 retainer as seen in FIG. 5 comprising a circular PVC disk having a predetermined diameter and thickness with a cover plate 45 mounting hole 46. The back side of the cover plate 45 is a mirror of the front side.

Figure 10:
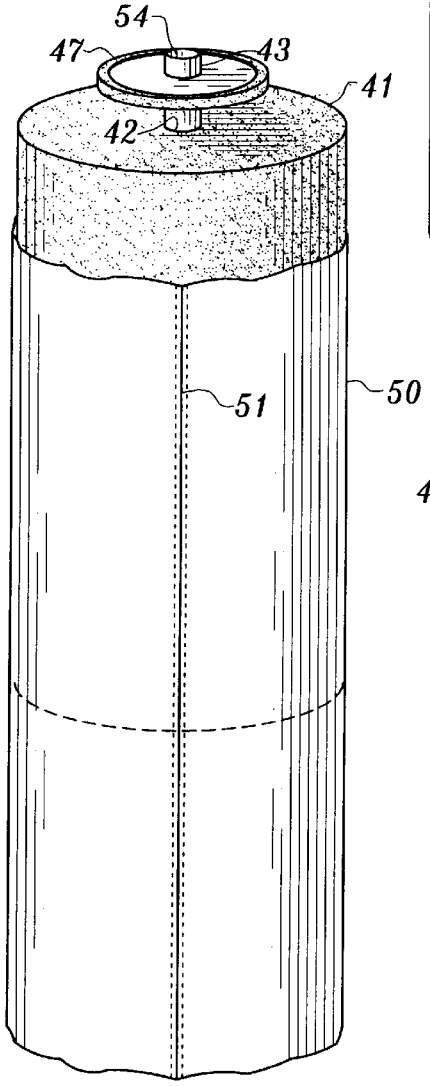
FIG. 10 is an enlarged constructional front and top view of the vinyl tack plates being installed around the mounting tube to rest on top of the foam cylinder before the vinyl covering is pulled up in place, with the bottom side presenting a mirror image of the top side.
Figure 12:
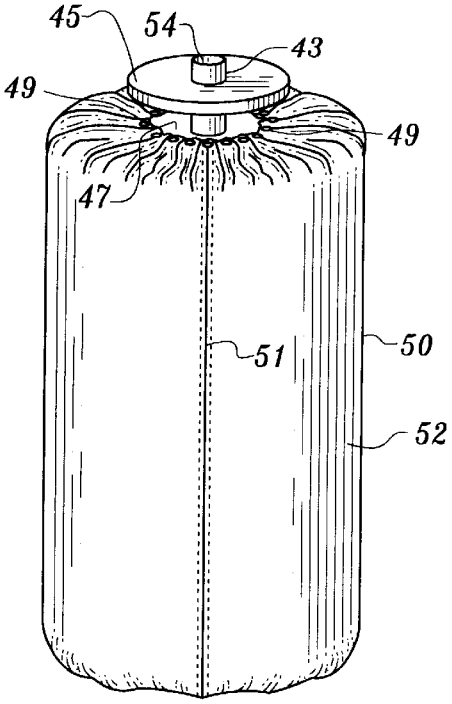
FIG. 12 is a constructional front and top view of the glance blow detecting bag showing the vinyl covering tuck in place in between the mounting tube and foam cylinder, with vinyl tack pins installed through the vinyl covering and tack plate in a circle around the mounting tube, with the cover plate slip over the bag mounting tube, with the bottom side presenting a mirror image of the top.
Figure 13:
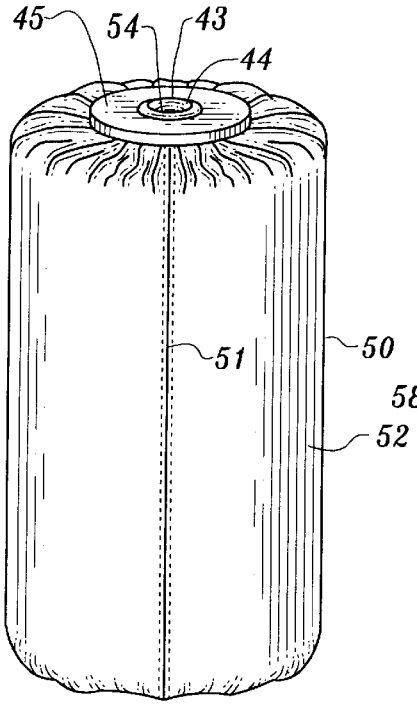
FIG. 13 is a perspective top and front view of a finished glance blow detecting bag finished by flaring out the top and bottom opening of the bag mounting tube, trapping the tack pins, vinyl covering, tack plates, and foam cylinder in place on the bag mounting tube, with the bottom and back being a mirror image of the front and top of the bag.

The cover plate 45 could be rectangular if desired. The cover plate 45 can be made out of other materials, for example metal, or synthetic materials. Other shapes can be used to make the cover plate 45. The cover plate 45 further comprises a cover plate 45 mounting hole 46 at its center, as seen in FIG. 5. The circular cover plate 45 mounting hole's 46 inside diameter is greater than the bag mounting tube 43 outer diameter to allow the cover plate 45 to slip over the bag mounting tube 43 leaving room to tack in the vinyl covering 50. The cover plate 45 is installed over the foam mounting tube 43 where the plastic mounting tube 43 ends 54 are softened and flared by heat at both ends 44 to retain all the bag hardware 52 as seen in FIG. 12. The foam cylinder 41, tack plate 47, and vinyl covering 50 are assembled in place on the top and bottom of the bag 52, as seen in FIG. 13 showing the cover plate 45 in place around the foam mounting tube 43 by heat flaring 44 out the tube 43 opening ends 54 to a greater diameter than the cover plate 47 diameter opening. The tube opening ends 54 are allowed to cool to permanently retain vinyl covering 50, tack plates 47 and vinyl tack pins 47 in place. The method of heat flaring 44 the ends of PVC tubing to mount and retain objects, such as but not limited to, foam cylinders, vinyl covering, vinyl tack plate, vinyl tack pins and cover plate 47 onto a PVC bag mounting tube 43 is provided comprising the following steps:

1. inserting a straight un-flared bag mounting tube 43 through the foam cylinder mounting hole 42 at the center of foam cylinder 41 as seen in FIG. 8;
2. installing vinyl covering 50 leaving a predetermined extra amount of vinyl cover 50 at both ends of the foam cylinder 41 for tucking in at the bag mounting tube 43 and tack plate 47 later, as seen in FIG. 10;
3. installing a vinyl tack plate 47 over the bag mounting tube 43 while resting the vinyl tack plate on the top of the foam cylinder 41, as seen in FIG. 10;
4. pulling the amount of vinyl covering 50 needed to cover tack plates 47 and to tuck down in between the tack plate, foam mounting hole 42 and the bag mounting tube 43, as seen in FIG. 11;
5. installing vinyl tack pins 49 around the bag mounting tube 43 through the vinyl covering 50, and through the vinyl tack plate 47 to hold covering 50 in place, as seen in FIG. 13;
6. installing the hardware cover plate 45 over the bag mounting tube 43 by pushing down on the foam cylinder 41 and vinyl covering 50, and by cutting the foam mounting tube 43 to desired length and heat flare 44 out the tube 43 openings ends 54 to a diameter greater than the cover plate 47 diameter opening;
7. letting end 54 cool to retain vinyl covering 50, tack plates 47 and vinyl tack pins 47 in place permanently; and
8. turning glance blow detecting bag 52 upside down and repeating steps 1 through 6 above to finish the opposite end, providing the bottom side of bag 52 as a mirror image of the of the top side of bag 52.

The glance blow detecting bag 52 further comprises a free standing pole mounting stand 67 which comprises two rectangular wooden cross members 68, each cross member 68 being approximately 4" by 4" and having a top side 93, center locking valley 70, and wherein each cross member 68 valley 70 has a circular pole mounting hole 88 at the center of the cross member 68 in the valley 70. The stand 67 pole mounting hole 88 has two sides, a plain top side 71 at the cross member top side 93 of the valley 70 as seen in FIG. 23, FIG. 26, and FIG. 27, and a bell out mounting hole 72 on the cross member bottom side 94 of each the cross member 68 as seen in FIG. 24, FIG. 26, and FIG. 27. Common non-marking rubber can be installed at the bottom of the members 68 to protect inside flooring members 68, and could be made out of plastic and filled with water. The bell 72 out area on the bottom of cross member 94 is for receiving and holding in place the bag mounting pole's 55 heat flared out end 57. The bag mounting pole 55 is inserted through both cross members 68 holding the flared end 57 of the bag mounting pole 55 in place, as seen in FIG. 26, FIG. 27, and FIG. 28. The stand 67 can be made in different shapes and sizes, or a different stand 67 can be used to support the bag mounting pole 55. Different materials can be used to make the stand 67, for example metal, or synthetic materials. The cross member pole mounting holes 88, are mirror images of each other to allow the two pole mounting holes 88 to line up at the center of the valley 70 when cross members are interlocked by placing one cross member 68 over the other and then over lapping at the valleys 70 in a cross shape. The cross members 68 are inter-changeable. The bag mounting pole beveled end 57 is trapped when inserted through the cross members 68. The stand 67 holds the bag mounting pole 55 vertically in place. The pole mounting stand 67 comprises two inter-locking cross members 68 which are approximately the same length, width, depth, and where each cross member 68 has a top side 93 and a valley 70 at the center. One cross member's 68 valley 70 area is approximately ⅛" wider at the valley 70 to allow the cross members 68 to enter locking into a cross shape stand 67 as seen in FIG. 25, FIG. 27 and FIG. 22. The two cross members 68 valley 70 depth is one half of the entire depth of the cross members 68, to allow the two top sides 93 of the cross members 68 to inter-lock at the valleys 70 to the same level and height on top and bottom, after interlocking. Each cross member 68 is a mirror of the other cross member 68, except for the ⅛" valley 70 difference in width. The stand's 67 primary function is to hold the bag mounting pole 55 in place vertically. The cross member 68 has spike holes 69 located at the end area of each cross member 68 for holding down the stand 67, in dirt or grass. Barbell weights are placed over the bag mounting pole and left to rest on top of cross members 68 to hold the stand 68 in place indoors.

The glance blow detecting bag 52 and stand 67 further comprise at leased one PVC pole vertical holding plate 64 as seen in FIG. 21, FIG. 22, FIG. 28, FIG. 29, FIG. 31, FIG. 34 and FIG. 35. The pole holding plate 64 comprises a rectangular shape of predetermined depth, thickness and length, and can be made out of plastic, metal or other materials. The pole vertical holding plate 64 primary function is to further support the bag mounting pole 55 vertically working as a second holding point to hold the bag mounting pole 55 in place vertically. The pole vertical holding plate 64 has a mounting hole 65 at the center of the plate 64 having a greater diameter opening than the outer diameter of the bag mounting pole 55, to allow the pole vertical holder 64 to slip over the bag mounting pole 55 to be hold in place with fasteners driven throw the holder plate fasteners holes 66 and cross members 68 when the bag mounting pole 55 is vertically aligned, as seen in FIG. 28. Two pole vertical holding plates 64 can be used in a cross form, crossing at the top of the stand 67 as seen in FIG. 22 and FIG. 29. The pole vertical holding plate 64 can be made with a vertical sleeve attached upward to accept the bag mounting pole, having a diameter greater than the bag mounting pole 55 to allow the vertical plate 64 to slip over bag mounting pole 55 freely and to rest on the top side the of stand 67 cross member 68. The vertical sleeve provides additional support for the bag mounting pole 55.

The pole mounting stand 67 further comprises at lease one stand spike hole 66 at each end of cross members 64 for use when the stand is mounted outside in the ground 76 areas; for example into dirt or grass substrate, by driving the stand spikes 62 through the cross members spike holes 66 into the substrate 76.

The stand 67 further comprise non- marking rubber at the area where each cross member contacts the floor, to protect flooring.

Barbell weights 61 are used to hold the stand 67 in place when spikes 62 can not be used. The barbell weights also can be added for further support if desired any time, as seen in FIG. 30, FIG. 32, and FIG. 35.

The glance blow detecting bag 52 and stand 67 can be assembled by using the method and the steps below:

1. inserting the bag mounting pole 55 through the bottom side of a cross member 68 with valley 70 up, leaving the flared out end 57 of the bag mount pole 55 to fit in place at the beveled hole 72 area on the bottom of the cross member 68, as seen in FIG. 26;
2. installing a second cross member 68 over bag mounting pole 55 in a cross shape, with the valley 70 pointing down, and inter-locking cross members 68 while holding bag mounting pole up vertically,
3. installing the pole vertical holder plate 64 over the bag mounting pole 55 and fastening the plate 64 in place with fasteners while keeping the bag mounting pole 55 straight;
4. installing the height adjustment sleeve 59 at bottom height positions with a fastener 58 through the sleeve fastener hole 60, and bag mounting pole 55 height adjustment hole 56 and holdings the adjustment sleeve and fastener in place with the wing nut 87;
5. installing the glance blow detecting bag over the bag mounting pole; and
6. installing the height adjustment sleeve 59 at the desired height at the top of bag mounting pole 55 with fastener 58 and a wing nut 87 to lock bag 52 in place.

The glance blow detecting punching, kicking, blocking bag 52 and stand 67 can be used by following the steps below:

1. assembling the glance blow detecting bag 52 and stand 67;
2. standing in front of bag 52 in a defensive posture, and hitting bag 52 in the middle to prevent spinning;
3. moving feet, ducking, and hitting the bag 52 in offensive and defensive postures, flexing the bag 52 backwards and forward as seen in FIG. 30; and
4. engaging two challenger boxers 73, kickers 74, or blockers 33, where the two challengers 73 must change from offensive to defensive postures as they use their feet and body work, while punching, kicking, or blocking to avoid being hit by the flexible bag 52 which moves backwards and forward and sideways, and where the challengers are given points for effective punches as indicated when the bag 52 does not spin on contact, and points are deducted for an inaccurate blow which causes the bag 52 to spin as seen in FIG. 31.

FIG. 20 shows a constructional view of another embodiment of the bag mounting pole 55 with a mounting hole 96 at the bottom opening 57 of the bag mounting pole 55 is mounted on a plastic to steel spike transition fitting 63 with a fastener 58 and a wing nut 87. The PVC transition tube 98 has a fastener 58 mounting hole 95 at the upper opening end of transition tube 98, and the transition fitting tube 98 has a smaller diameter than the bag mounting pole 55 open bottom end 57 to allow the bag mounting pole 55 bottom end 57 to fit over the plastic to steel spike transition fitting 63 which is held in place with a fastener 58 and wing nut 87 at transition mounting holes 95 and pole mounting hole 96 as seen in FIG. 20, FIG. 34, and FIG. 35. FIG. 30. illustrates the glance blow detecting bag 52 flexing back toward the boxer 73 making the boxer 73 duck to avoid being hit by bag 52, while the boxer 73 stands in a defensive posture as the bag 52 passes by the boxer's 73 shoulder rapidly.

FIG. 33 shows the glance blow detecting bag 52 and bag mounting pole 55 used as a blocking and tackling bag by leaving the fastener 58 out at the transition fitting 63 to allow bag mounting pole 55 to fight off the plastic to steel spike transition fitting 63 when hit with a block or tackle.

FIG. 32 shows a marshal art kick boxer 74 kicking the bag 52 in a offensive posture, and shows the flexible movement of the bag 52 when bag 52 is hit with a blow, wherein the arrows indicate direction of glance blow.

FIG. 33 shows how to train a football player 75 to block the glance blow detecting bag 52 with the bag mounting pole 55 mounted directly to a plastic to steel transition fitting 63 showing the bag 52 spinning rapidly to the right detecting football player's 75 glancing block, and the position of the bag 52 after the glance block.

FIG. 34 shows the glance blow detecting bag 52 and bag mounting pole 55 mounted on a plastic to steel spike transition fitting 63 comprising a PVC transition tube 98 which has a smaller diameter than the transition spike 97, the transition tube 98 also has a tube mounting hole 95, a transition spike 97 which has a larger diameter than the transition tube 98 to allow the spike to be inserted at bottom end of tube 98 by heat softening the tube 98 bottom end and inserting the transition spike 97 through the softened plastic transition tube 98. The transition spike 97 is held tightly in place when the plastic tube 98 cools to original shape. The bag mounting pole 55 has a pole mounting hole 96 at the bottom of pole 55 for mounting the pole 55 directly over the plastic to steel transition fitting 63, which is held in place firmly with a fastener 58 and wing nut 87. The transition spike 97 is forced into the ground 76, and the bag mounting pole 55 is further supported with a pole vertical holder plate 64.

FIG. 35 shows the glance blow detecting bag 52 and bag mounting pole 55 mounted on a plastic to steel spike transition fitting 63 comprising a PVC transition tube 98 which has a smaller diameter than the transition spike 97. The transition tube 98 also has a tube mounting hole 95 and a transition spike 97 which has a larger diameter than the transition tube 98 to allow the spike to be inserted at bottom end of tube 98 by heat softening the PVC tube 98 bottom end and inserting the transition spike 97 through the softened plastic transition tube 98. The transition spike 97 is held tightly in place when the plastic tube 98 cools to original shape. The bag mounting pole 55 has a pole mounting hole 96 at the bottom of pole 55 for mounting the pole 55 directly over the plastic to steel transition fitting 63 which has a transition fitting mounting hole 95, the pole 55 and transition fitting are held in place firmly with a fastener 58 and wing nut 87. The transition spike 97 is forced into the ground 76, and the bag mounting pole 55 is further supported with a pole vertical holder plate 64 and barbell 61. The plastic to steel transition fitting is installed using the following steps:

1. driving the transition fitting into the ground straight vertically;
2. installing the bag mounting pole over the transition fitting;
3. installing fastener 58 through the transition fitting mounting hole 95 and the pole mounting hole 96, to hold the fastener in place with a wing nut;
4. installing a vertical holding plate 64 over the transition fitting to hold plate 64 in place with spikes 62;
5. installing a lower bag adjustment sleeve and top adjustment sleeve 59, to the bag 52.

FIG. 36 illustrates an embodiment of the foam cylinder 41 showing a split foam cylinder 78 split to the center 81 to allow the bag mounting tube 43 to be placed at the center 81 of the split foam cylinder 78. This is the optional method of mounting a foam cylinder 41 to a bag mounting tube 43.

FIG. 37. is a constructional view of the bag mounting tube 43 being installed to the foam cylinder center 81 of the spilt foam cylinder 78 by using foam adhesive spray 79 to seal up the spilt foam cylinder 78. This is a optional method of mounting a foam cylinder 41 with out the center mounting hole 42 to the foam mounting tube 43.

FIG. 38 illustrates the split foam cylinder 78 after application of the adhesive 79 sealing back together, showing the sealed seam 80.

FIG. 39 illustrates the glance blow detecting punch, kick, a blocking bag 52 showing a common rope 82 inserted through the center opening 54 of bag mounting tube 43, having a knot 83 at the opposite end of rope 82 to trap the bag 52.

Figure 1:
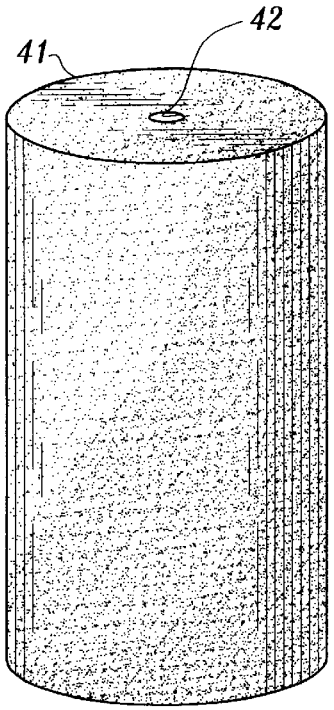
FIG. 1 shows an enlarged plain front and top view of a glance blow detecting foam cylinder with foam mounting hole.
Figure 2:
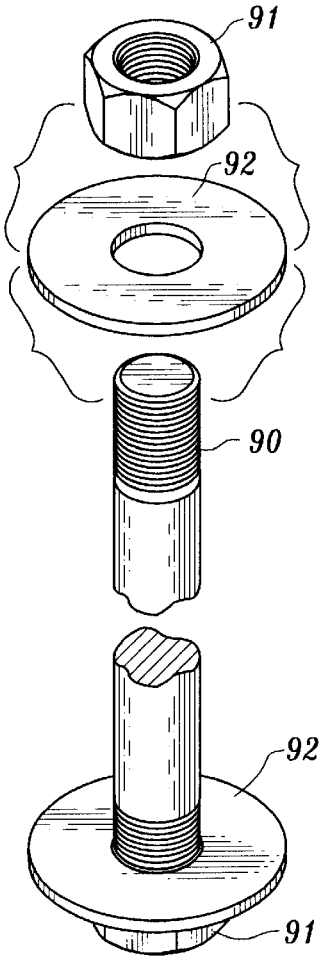
FIG. 2 is a view of an embodiment of the bag mounting tube showing a threaded bag mounting nipple, with retainer nut and washer.
Figure 3:
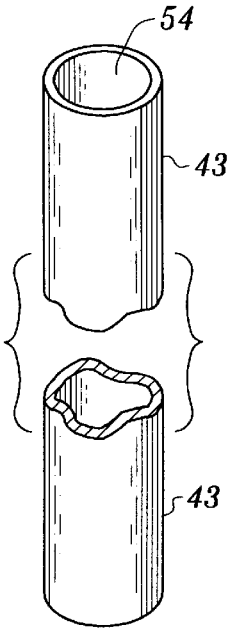
FIG. 3 shows a enlarged plain view of the glance blow detecting bag mounting tube with open ends.

FIG. 40 illustrates an embodiment of the glance blow punching, kicking, blocking bag 52 using a threaded 90 pivotal bag mounting tube 43, consisting of a threaded 90 tube 43 of a predetermined length, and inside diameter, to allow mounting onto the bag mounting pole 55. The tube 43 has threads 90 on both ends to accept a retainer nut 91 and washer 91, as seen in FIG. 2, and which retains the foam cylinder 41, vinyl tack plate 47, vinyl covering 50, and tack pins 49, in place on the top and bottom area of the bag 52.

RAMIFICATIONS

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention, for example:

1. The bag mounting tube 43, and bag mounting pole 55 can be made out of fiberglass, or other plastic solid rod or metal, and cold flared or heat flared.
2. The bag mounting pole 55, stand 67, and plastic to steel spike transition fitting can be used as an umbrella holder.
3. The stand 67 can have non-marking rubber at the bottom to protect flooring.
4. The bag 52 could be used as decorative pillows, the pillows could take different decorative shapes, and forms by using finish bag 52 on a bag mounting tube.
5. The bag mounting pole 55 can be a solid rod, constructed from fiber glass, metal or synthetic materials.
6. Common non marking rubber can be installed at the bottom of the members 68 to protect inside flooring; and the members 68 could be made out of plastic and filled with water.
7. The bag mounting pole 55 can be mounted on a short nipple approximately 1" deep with out a fastener 58 so the pole 55 will fly off when hit with a block or tackle.
8. The transition fitting can be constructed from materials ranging from wood to plastic for fence post root protection.
9. The bag mount pole could be solid, to eliminate the flexibility of the pole.
10. The foam cylinder and hardware can be retained on the bag mounting tube in other ways, for example; threaded bag mounting tube metal washer, screw and nut, metal rings, plastic sleeve, PVC slip coupling and other retaining means can be used.
11. The transition fitting cable used for a mounting stand for height adjustable pole vault pole, volley ball net pole, and high jump pole for holding a high jump bar.
12. The vertical holding plate could be made out of metal.
13. The support stand cross members could be water filled plastic cross members.
14. The bag mounting tube 43 could be extended and used as the bag mounting tube 43 and the bag mounting pole 55, held in place with adjustment sleeves 59 or flaring tube 44 ends to eliminate the bag mounting pole 55.
15. The pivotal glance pole detecting punching, kicking, and blocking bag 54 could be mounted directly to the bag mounting pole 55 to eliminate the bag mounting tube 43 by flaring the top of bag mounting pole 55 on top and using adjustment sleeves 59 at the bottom of the bag 55 to hold the bag 52 in place on the bag mounting pole 55.

16. The pivotal foam cylinder could be mounted directly to the pole mounting tube or pole mounting pole with hardware described above.

The embodiments described are selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A glancing blow detecting apparatus comprising:

a flexible mounting pole having a upper portion and a lower portion;

the lower portion of the mounting pole secured to a stand such that the mounting pole is substantially vertically oriented;

a striking bag rotatably mounted to the upper portion of the mounting pole for free rotational movement about a longitudinal axis of the mounting pole;

the striking bag comprising a foam cylinder with first and second ends and having a central bore extending between the first and second ends along a longitudinal axis;

a protective covering secured around the foam cylinder;

the covering having upper and lower edges, each edge secured between a first plate and a cover to encase the foam cylinder;

each first plate and cover plate having a central aperture collinear with the central bore of the foam cylinder;

a mounting tube extending through the central bore of the foam cylinder and the central apertures of the first plates and the cover plates, and having first and second ends flared to retain the covering, the first plates and the cover plates to the foam cylinder;

the mounting tube mounted collinear with the upper portion of the mounting pole and retained on the upper portion by upper and lower supports; and the upper and lower supports selectively positionable along the length of the upper portion of the mounting pole, wherein the striking bag freely rotates radially about the mounting pole when struck by a glancing blow and the flexibility of the mounting pole permits flexion in reaction to more direct blows by the user.

2. The glancing blow detecting apparatus of claim 1, wherein the upper and lower supports comprise sleeves selectively secured to the mounting pole.

3. The glancing blow detecting apparatus of claim 1, wherein the mounting tube comprises PVC material.

4. The glancing blow detecting apparatus of claim 1, wherein the flexible mounting pole comprises fiberglass material.

5. The glancing blow detecting apparatus of claim 1, wherein the stand comprises interlocked first and second cross members.

6. The glancing blow detecting apparatus of claim 1, wherein the stand supports free weights to stabilize the apparatus.

7. The glancing blow detecting apparatus of claim 1, wherein the stand includes a spike for inserting into a support surface.

8. The glancing blow detecting apparatus of claim 1, wherein each first plate is a tack plate, and the edge of the protective covering is secured to a respective tack plate by tack pins.

* * * * *